US006568199B1

(12) United States Patent
Manohar et al.

(10) Patent No.: US 6,568,199 B1
(45) Date of Patent: May 27, 2003

(54) METHOD FOR OPTIMIZING COEFFICIENT OF PERFORMANCE IN A TRANSCRITICAL VAPOR COMPRESSION SYSTEM

(75) Inventors: Shailesh Sharad Manohar, Manlius, NY (US); Young Kyu Park, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/054,421

(22) Filed: Jan. 22, 2002

(51) Int. Cl.[7] ..... F25B 41/00; F25B 1/00
(52) U.S. Cl. ..... 62/223; 62/204
(58) Field of Search ..... 62/223, 204

(56) References Cited

U.S. PATENT DOCUMENTS 6,044,655 A 4/2000 Ozaki et al. ..... 62/205
6,105,380 A 8/2000 Yokomachi et al. ..... 62/228.2
6,343,486 B1 * 2/2002 Mizukami ..... 62/509
6,418,735 B1 * 7/2002 Sienel ..... 62/115
6,430,949 B2 * 8/2002 Noro et al. ..... 62/183

* cited by examiner

*Primary Examiner*—William Wayner
(74) *Attorney, Agent, or Firm*—Carlson, Gaskey & Olds, P.C.

(57) ABSTRACT

The high side pressure of a vapor compression system is selected to optimize the coefficient of performance by measuring the heat sink inlet temperature with a temperature sensor. For any heat sink inlet temperature, a single optimal high side pressure is selected which optimizes the coefficient of performance. The optimal high side pressure for each heat sink inlet temperature is preset into a control and is based on data obtained by previous testing. A pressure sensor continually measures the high side pressure. If the high side pressure is not at the optimal value, the expansion device setting is adjusted to alter the high side pressure to the optimal value.

22 Claims, 2 Drawing Sheets

METHOD FOR OPTIMIZING COEFFICIENT OF PERFORMANCE IN A TRANSCRITICAL VAPOR COMPRESSION SYSTEM

BACKGROUND OF THE INVENTION

The present invention relates generally to a method for optimizing the coefficient of performance of a transcritical vapor compression system by measuring the heat sink inlet temperature and adjusting the high side pressure to an optimum value according to a preset control strategy.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run transcritical, or above the critical point.

When a vapor compression system runs transcritical, the refrigerant does not change phases from vapor to liquid while passing through the heat rejecting heat exchanger. Therefore, the heat rejecting heat exchanger operates as a gas cooler in a transcritical cycle, rather than as a condenser. The pressure of a subcritical fluid is a function of temperature under saturated conditions (where both liquid and vapor are present). However, the pressure of a transcritical fluid is a function of fluid density when the temperature is higher than the critical temperature.

It is important to regulate the high side pressure of a transcritical vapor compression system as the high side pressure has a large effect on the capacity and efficiency of the system. In one prior system, the optimal coefficient of performance is maintained by sampling the refrigerant temperature and pressure at the outlet of the gas cooler and adjusting the high side pressure to an optimum value according to a predetermined control strategy. In another prior system, the high side pressure and low side pressure are coupled based on a pre-determined control strategy to adjust the high side pressure to an optimum value to maintain the optimal coefficient of performance.

SUMMARY OF THE INVENTION

A transcritical vapor compression system includes at least a compressor, a heat rejecting heat exchanger, an expansion device, and a heat accepting heat exchanger. Of course, this is a simplified system and other components may be included. Refrigerant circulates through the closed circuit system. Preferably, carbon dioxide is employed as the refrigerant. High pressure refrigerant flowing through the heat rejecting heat exchanger is cooled by a fluid, such as water, flowing in an opposing direction through a heat sink. The vapor compression system further includes a heat pump to reverse the flow of the refrigerant and change the system between a heating mode and a cooling mode.

In a transcritical vapor compression system, the high side pressure is independent of the operating conditions. Therefore, for any set of operating conditions, it is possible to operate the cycle at a wide range of high side pressures. For any set of operating conditions, there is also an optimal high side pressure which corresponds to an optimum coefficient of performance. Two variables determine the operating conditions: the outdoor air temperature and the heat sink inlet temperature. As the outdoor air temperature only slightly influences the optimal high side pressure, and therefore the coefficient of performance, only the heat sink inlet temperature significantly affects the optimal high side pressure.

In selecting the optimal high side pressure, and therefore achieving the optimal coefficient of performance, a temperature sensor measures the heat sink inlet temperature. For any heat sink inlet temperature, a single optimal high side pressure is selected to optimize the coefficient of performance. The optimal high side pressure for each heat sink inlet temperature is preset into a control and is based on data obtained by previous testing. A pressure sensor continually measures the high side pressure. If the high side pressure is not optimal, the expansion device is adjusted to alter the high side pressure to the optimal value.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
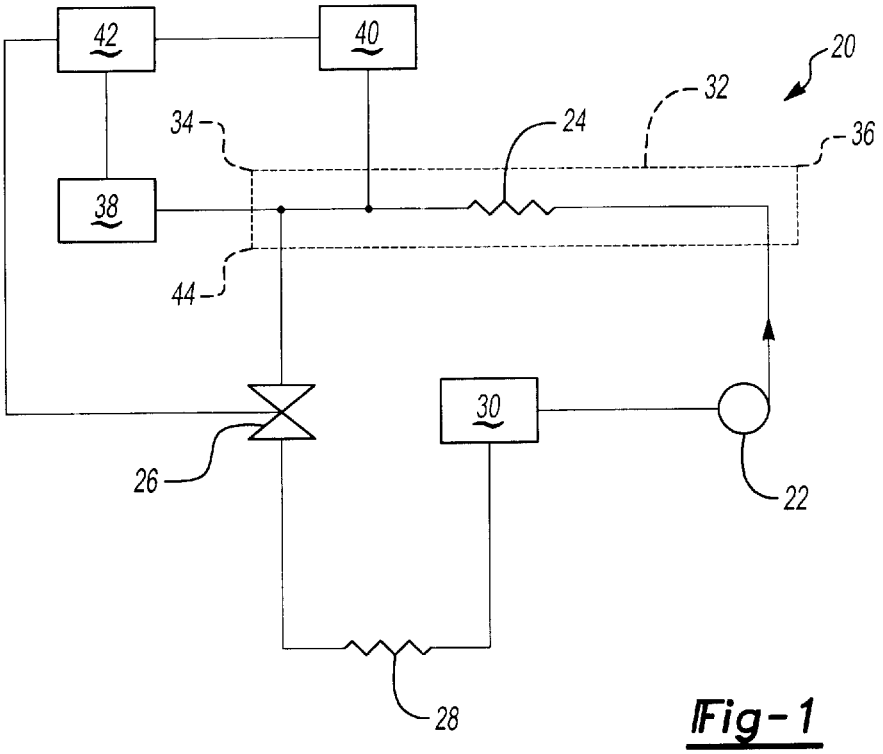
FIG. 1 illustrates a schematic diagram of the vapor compression system of the present invention.

FIG. 1 illustrates a schematic diagram of the vapor compression system 20 of the present invention. The system 20 includes a compressor 22, a first heat exchanger 24, an expansion device 26, and a second heat exchanger 28. Refrigerant circulates though the closed circuit system 20. When operating in a heating mode, after the refrigerant exits the compressor 22 at high pressure and enthalpy, the refrigerant flows through the first heat exchanger 24, which acts as a gas cooler, and loses heat, exiting the first heat exchanger 24 at low enthalpy and high pressure. A fluid medium, such as water, flows through the heat sink 32 and exchanges heat with the refrigerant passing through the first heat exchanger 24. The cooled water enters the heat sink 32 at the heat sink inlet or return 34 and flows in a direction opposite to the direction of flow of the refrigerant. After exchanging heat with the refrigerant, the heated water exits at the heat sink outlet or supply 36. The refrigerant then passes through the expansion device 26, and the pressure drops. After expansion, the refrigerant flows through the second heat exchanger 28, which acts as an evaporator, and exits at a high enthalpy and low pressure. The refrigerant passes through a reversible valve 30 of a heat pump and then re-enters the compressor 22, completing the system 20. The reversible valve 30 can reverse the flow of the refrigerant to change the system 20 from the heating mode to a cooling mode.

In a preferred embodiment of the invention, carbon dioxide is used as the refrigerant. While carbon dioxide is illustrated, other refrigerants may benefit from this invention. Because carbon dioxide has a low critical point, systems utilizing carbon dioxide as a refrigerant usually require the vapor compression system 20 to run transcritical.

In a transcritical vapor compression system 20, the high side pressure is independent of the operating conditions. Therefore, for any set of operating conditions, it is possible to operate the system 20 at a wide range of high side pressures. For any set of operating conditions, there is also an optimal high side pressure which corresponds to an optimal coefficient of performance. The coefficient of performance is representative of system efficiency and equals the total useful heat transferred divided by the work put into the cycle. As the high side pressure influences the coefficient of performance, it is important to regulate the high side pressure to optimize the coefficient of performance.

Figure 2:
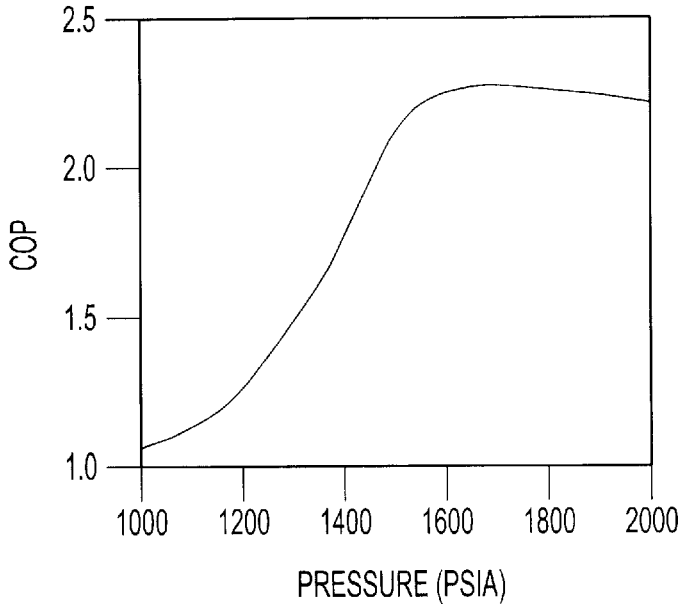
FIG. 2 illustrates a graph relating pressure to the coefficient of performance in a transcritical vapor compression system for a specific set of operating conditions.

FIG. 2 illustrates the relationship between the high side pressure and the coefficient of performance at a given set of operating conditions. For the given set of operating conditions, one high side pressure, the optimal high side pressure, corresponds to the optimum coefficient of performance. In the illustrated example, the coefficient of performance varies between 1.1 to 2.2 and reaches a maximum of 2.2 at a pressure of at about 1700 psia.

Figure 3:
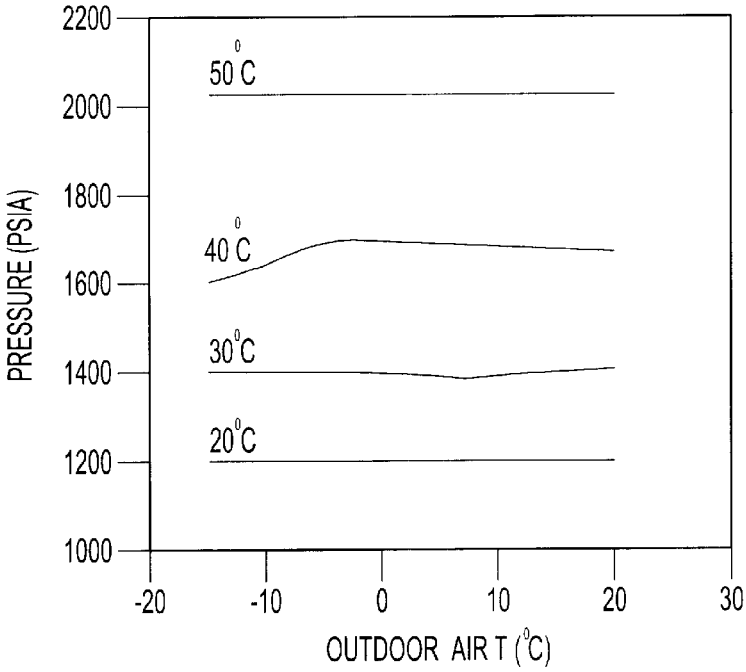
FIG. 3 illustrates a graph relating outdoor temperature to the optimum high side pressure in a transcritical vapor compression system for various heat sink inlet temperatures.

Two variables determine the operation conditions: the outdoor air temperature and the heat sink inlet temperature. Typically, the outdoor air temperature varies between 20° C. and 30° C. and the heat sink inlet temperature varies between 5° C. (for tap water heating) to 60° C. (for a radiator system). FIG. 3 illustrates the relationship between the outdoor temperature and the optimum high side pressure at various heat sink inlet temperatures. As shown, the outdoor air temperature has a minimal effect on the optimal high side pressure, and therefore the coefficient of performance. That is, as the outdoor air temperature changes, the optimal high side pressures for a given set of operating conditions varies only slightly. Therefore, as the outdoor air temperature does not influence the optimal high side pressure, only the heat sink inlet temperature significantly affects the optimal high side pressure.

For any set of operating conditions, a single high side pressure is selected to optimize the coefficient of performance, independent of the outdoor air temperature. The optimal high side pressure for any heat sink inlet temperature is determined by previous testing, and the results of the previous testing are preset into a control 42. That is, there is a predetermined optimum high side pressure for each heat sink inlet temperature.

Figure 4:
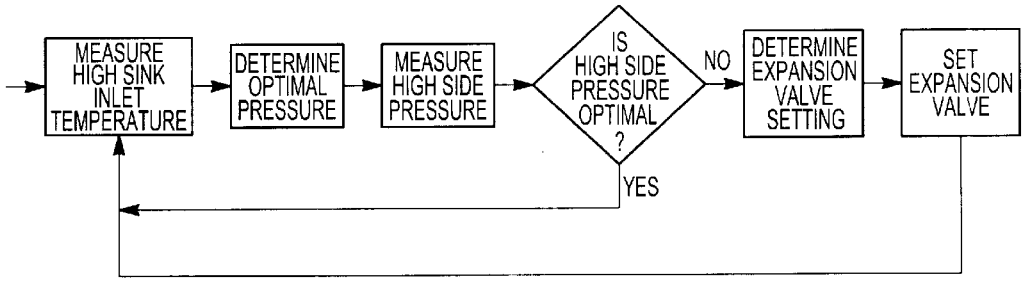
FIG. 4 illustrates a flow chart of the method of the present invention.

A flowchart of the method of the present invention is illustrated in FIG. 4. Returning to FIG. 1, during operation of the system 20, the heat sink inlet temperature is measured by a temperature sensor 38. Based on this temperature, the control 42 determines the optimal high side pressure based on the data preset into the control 42.

A pressure sensor 40 continuously measures the high side pressure of the system 20. If the control 42 determines that the high side pressure measured by the pressure sensor 40 is not the optimal high side pressure as determined by the heat sink input temperature, the control 42 determines the proper expansion device setting and adjusts the expansion device 26 to change the high side pressure to the optimal high side pressure. Appropriate controllable expansion devices are known. By determining the optimal high side pressure by measuring the heat sink inlet temperature and adjusting the expansion device 26 to maintain the optimal high side pressure, the optimum coefficient of performance can be maintained over a wide range of operating conditions.

Although it is disclosed that the temperature sensor 38 directly measures the heat sink inlet temperature, it is to be understood that the heat sink inlet temperature can also be measured indirectly. For example, the temperature of the housing 44 of the heat sink inlet 34 can be measured to determine the optimal high side pressure. Any characteristic indicative of the heat sink inlet temperature can be measured to determine the optimal high side pressure.

The present invention can be employed in hydronic fan coil heating, domestic hot water heating, or hydronic space heating. However, it is to be understood that other types of heating systems can be employed.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A transcritical vapor compression system comprising:

a compression device to compress a refrigerant to a high pressure;

a heat rejecting heat exchanger for cooling said refrigerant by exchanging heat with a fluid entering said heat rejecting heat exchanger at an inlet temperature;

an expansion device for reducing said refrigerant to a low pressure;

a heat accepting heat exchanger for evaporating said refrigerant; and a control to determine a desired high pressure of said refrigerant based on a characteristic indicative of said inlet temperature of said fluid and to adjust said high pressure to said desired high pressure.

2. The system as recited in claim 1 wherein said inlet temperature is measured by a temperature sensor.

3. The system as recited in claim 1 wherein said high pressure is measured by a pressure sensor.

4. The system as recited in claim 1 wherein said control adjusts said high pressure to said desired high pressure by adjusting said expansion device.

5. The system as recited in claim 1 wherein said desired high pressure corresponds to an optimal coefficient of performance.

6. The system as recited in claim 1 wherein said fluid is water.

7. The system as recited in claim 1 wherein said refrigerant is carbon dioxide.

8. The system as recited in claim 1 wherein said inlet temperature is less than 60° C.

9. The system as recited in claim 1 wherein said characteristic is said inlet temperature.

10. The system as recited in claim 1 wherein said high side pressure is determined based on preset data.

11. A transcritical vapor compression system comprising:

a compression device to compress a refrigerant to a high pressure;

a heat rejecting heat exchanger for cooling said refrigerant by exchanging heat with a fluid entering said heat rejecting heat exchanger at an inlet temperature;

an expansion device for reducing said refrigerant to a low pressure;

a heat accepting heat exchanger for evaporating said refrigerant;

a pressure sensor for sensing said high pressure;

a temperature sensor for sensing said inlet temperature;

a control to determine a desired high pressure of said refrigerant based on said inlet temperature of said fluid and to adjust said high pressure to said desired high pressure by adjusting said expansion device, said desired high pressure corresponding to an optimal coefficient of performance.

12. The system as recited in claim 11 wherein said fluid is water.

13. The system as recited in claim 11 wherein said refrigerant is carbon dioxide.

14. The system as recited in claim 11 wherein the inlet temperature varies between 10° C. to 60° C.

15. The system as recited in claim 11 wherein said high side pressure is determined based on preset data.

16. A method of optimizing a coefficient of performance of a transcritical vapor compression system comprising the steps of:

compressing a refrigerant to a high pressure;

cooling said refrigerant by exchanging heat in said refrigerant with a fluid flowing in a heat sink;

expanding said refrigerant to a low pressure;

evaporating said refrigerant;

measuring a characteristic indicative of an inlet temperature of said fluid;

determining a desired high pressure of said refrigerant based on said characteristic of said inlet temperature of said fluid, said desired high pressure corresponding to said coefficient of performance; and adjusting said high pressure to said desired high pressure.

17. The method as recited in claim 16 wherein the step of adjusting said high pressure includes determining a degree of expansion.

18. The method as recited in claim 17 wherein the step of adjusting said high pressure further includes adjusting a degree of expansion.

19. The method as recited in claim 16 further comprising the step of measuring said high pressure.

20. The method as recited in claim 16 wherein said fluid is water.

21. The method as recited in claim 16 wherein said refrigerant is carbon dioxide.

22. The method as recited in claim 16 wherein said characteristic is said inlet temperature.

* * * * *